United States Patent [19]

Hood

[11] Patent Number: 4,827,548

[45] Date of Patent: May 9, 1989

[54] VEHICLE ENTRANCE RAMP

[75] Inventor: Delos W. Hood, Reno, Nev.

[73] Assignee: Transpec Inc., Troy, Mich.

[21] Appl. No.: 197,157

[22] Filed: May 23, 1988

[51] Int. Cl.[4] ..... E01D 1/00

[52] U.S. Cl. ..... 14/71.1

[58] Field of Search ..... 14/69.5, 71.1, 71.3; 414/522, 537; 296/61

[56] References Cited

U.S. PATENT DOCUMENTS

| | | | |
|---|---|---|---|
| 3,003,167 | 10/1961 | Smith | 14/71.1 |
| 4,078,678 | 3/1978 | Tordella | 14/69.5 X |
| 4,722,109 | 2/1988 | Mountz | 14/71.1 |
| 4,759,682 | 7/1988 | Hood | 14/71.1 X |

*Primary Examiner*—Jerome W. Massie, IV
*Assistant Examiner*—Matthew Smith
*Attorney, Agent, or Firm*—Reising, Ethington, Barnard, Perry & Milton

[57] ABSTRACT

The present invention relates to an extendible and retractable ramp device for a vehicle particularly concerned with the loading and unloading of a handicapped person and which device particularly includes a power actuating mechanism disposed within the vehicle in such a way as to both protect the mechanism from damage and further including a track mechanism for lifting one end of the ramp to the vehicle floor level when the ramp is in its extended position.

10 Claims, 7 Drawing Sheets

VEHICLE ENTRANCE RAMP

BACKGROUND OF THE INVENTION

The present invention relates to vehicle entranceways and exitways and, particularly, to stowable ramps associated therewith for facilitating the passage therethrough of wheelchairs and persons unable to negotiate one or more steps up into the vehicle.

There has long been a need for an extendible ramp at the entranceway of a motor bus, for example, over which a wheelchair passenger or other handicapped person might traverse in entering or leaving the vehicle at a bus stop. Several years ago, Donald L. Manning was granted U.S. Pat. No. 4,131,209 covering such an extendible ramp device. An improvement patent U.S. Pat. No. 4,685,858 was granted to Manning and Hood on Aug. 11, 1987. A further improvement is shown in copending U.S. application Ser. No. 046,402—Hood, filed 5-6-87 now U.S. Pat. No. 4,759,682. The present device is an improvement in certain aspects of the earlier ramp designs.

In the earlier ramp designs, a bell crank and power piston mechanism was utilized to lift the inner end of the ramp to vehicle floor level when the ramp was in its extended position outward of the vehicle. The present invention eliminates the bell crank and power piston mechanisms and instead utilizes a simplified inclined track and roller system to raise the inner end of the ramp as it approaches its extended position.

The present invention also includes a pivotal step riser spring-biased to its normal or vertical position when the ramp is retracted and a cam/follower device actuated by the ramp to position the riser upon the ramp when the latter is in its extended position.

Finally, the present invention includes a sensitive edge articulated transversely to the outer end of the ramp to provide a smooth transition from the extended ramp to the ground. The improvement in such sensitive edge including a spring member for extending the edge to a generally coplanar position relative to the upper ramp surface when the ramp is extended and a cam/follower device for rotating the edge from its coplanar position when the ramp is retracted.

PRIOR ART

The closest prior art device of which we are aware are the already mentioned U.S. Pat. Nos. 4,131,209, 4,685,858 and copending application Ser. No. 046,402 filed May 6, 1987.

The following additional patents were cited during the prosecution of the above noted patents:

U.S. Pat. No. 1,717,303—Barclay
U.S. Pat. No. 2,573,496—Runkle
U.S. Pat. No. 2,797,104—Drobney et al
U.S. Pat. No. 3,703,361—Haynes
U.S. Pat. No. 4,022,337—Eichenhofer et al
U.S. Pat. No. 4,027,807—Thorley
U.S. Pat. No. 4,058,228—Hall
U.S. Pat. No. 4,133,437—Gates
U.S. Pat. No. 4,140,230—Pearson
U.S. Pat. No. 4,306,634—Sangster
U.S. Pat. No. 4,564,086—Kingston With the exception of the Manning patents, none of the prior art references relate to a power actuated ramp. Drobney et al, Eichenhofer and Thorley relate to power actuated steps and the related devices could not be negotiated by a wheelchair or traversed by any person who could not handle one or more steps. The remaining references are not deemed relevant to the present invention.

SUMMARY OF THE INVENTION

It is among the principle objects of our invention to provide a power operated ramp to facilitate wheelchair passengers and the like in entering and leaving a vehicle, such as a motor bus; provide such a ramp which is normally stowed below the vehicle floor adjacent an entranceway to the vehicle and, when extended, moves outwardly through the entranceway and automatically tilts upwardly towards its inner end to provide a rigid inclined platform leading to the sidewalk or roadway exteriorly of the vehicle; to provide such a ramp whose extendible end portion is spaced below the vehicle floor to serve as a step for other persons entering the vehicle when the ramp is in its stowed position; to provide such a ramp including a normally vertical step riser in the vehicle entranceway which swings upwardly about the adjacent edge of the vehicle floor to cover the innermost end portion of the ramp when the latter is in its fully extended position; to provide a ramp actuating mechanism which is separate from the ramp and remains entirely inside the vehicle whereby such mechanism is prevented from being damaged or interfering with the use of the ramp by a handicapped passenger; and to provide a track and roller mechanism for raising the inner end of the ramp to vehicle floor level when the ramp is in its fully extended position outward of the vehicle.

The means by which the above-stated objects and advantages of the invention are realized will be clearly understood from the following description of a preferred embodiment thereof selected for the purposes of illustration, having reference to the drawings, wherein:

DESCRIPTION OF THE PREFERRED EMBODIMENT

Figure 1:
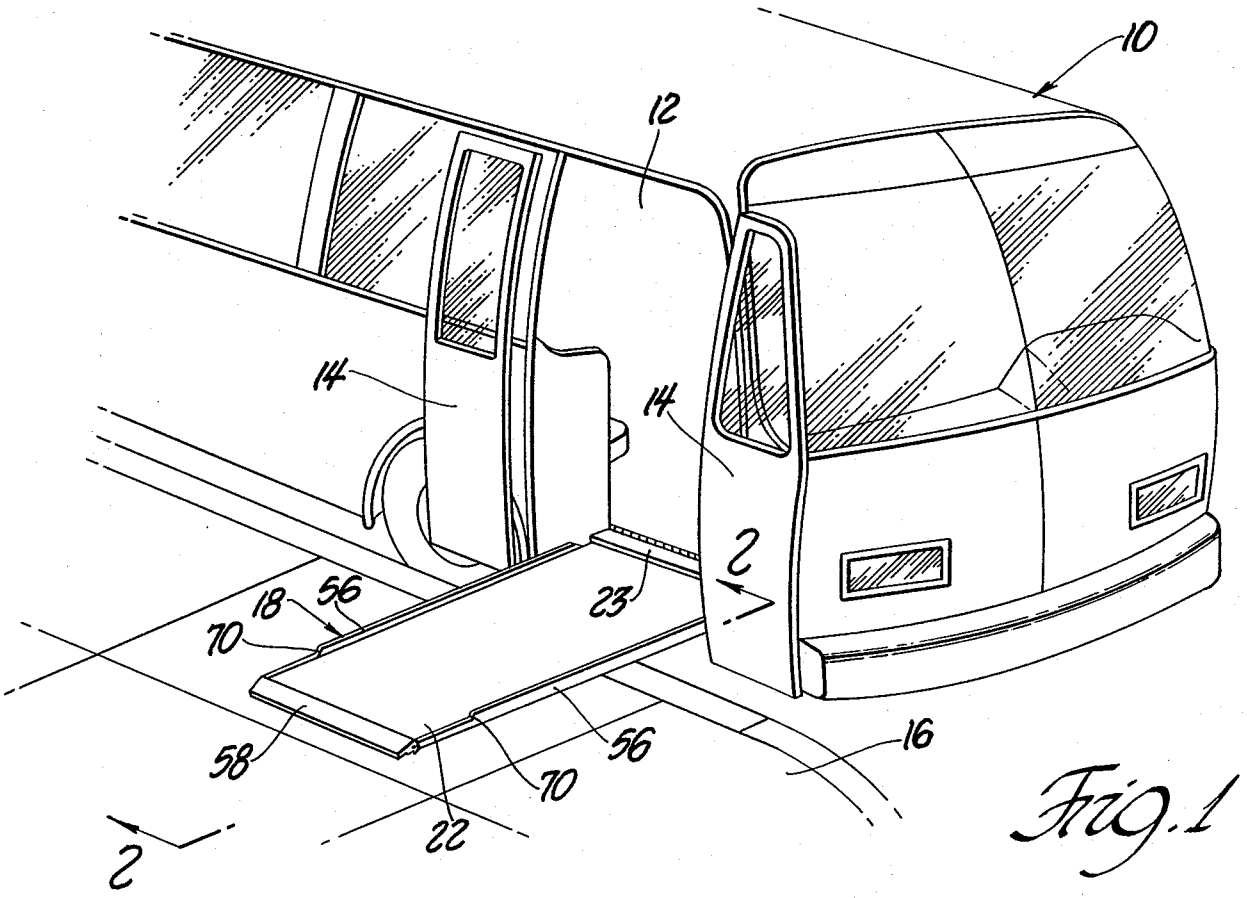
FIG. 1 is a perspective view of a motor bus having a side entranceway with the improved ramp in its fully extended position and at rest on a sidewalk.
Figure 2:
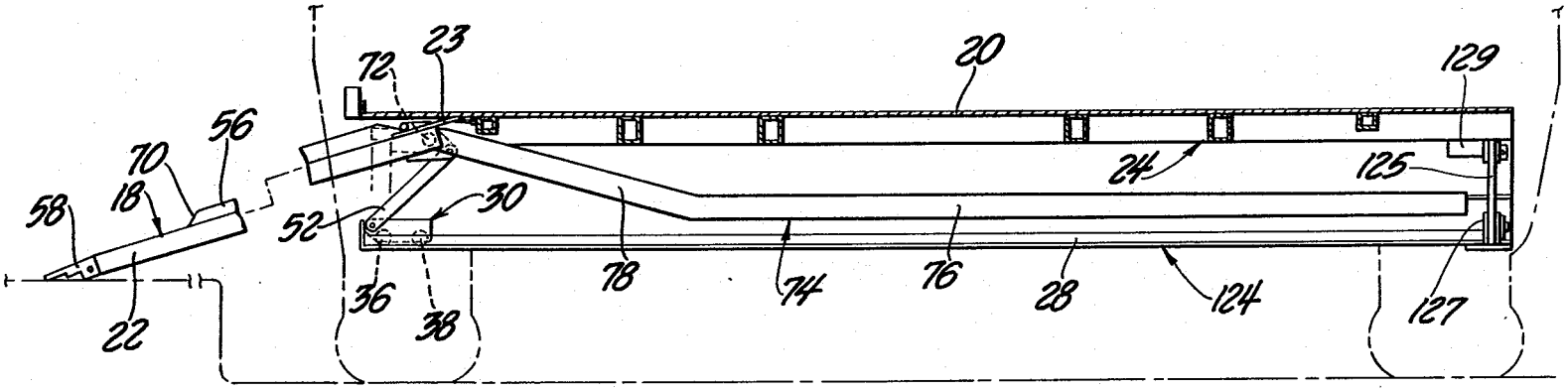
FIGS. 2 and 3 are transverse views of a bus showing the ramp and associated operating mechanism in a fully extended position and a fully retracted position.
Figure 3:
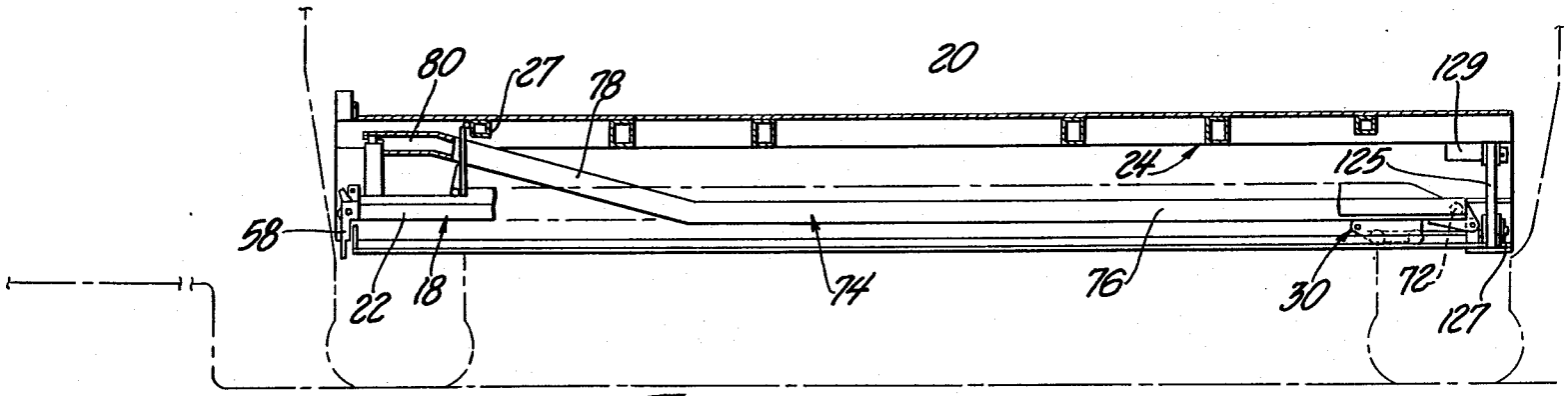

As best seen by reference to FIGS. 1 through 3, a motor bus in indicated generally at 10 and includes a front passenger opening 12 generally opposite the driver's position and adapted to be closed by doors 14. In these views the bus is shown parked next to a curb and sidewalk area indicated at 16. An extendible ramp is indicated generally at 18 and is shown in FIGS. 1 and 2 in its fully extended position ready to receive a wheelchair or handicapped person.

Referring specifically to FIG. 3, ramp 18 is shown in its fully retracted position beneath the vehicle floor 20. In this position, the outer most portion 22 of the ramp 18 is disposed within the front door entrance well and along with riser 23 forms a step for normal movement into and out of the bus under conditions in which the use of the ramp is unnecessary.

Figure 6:
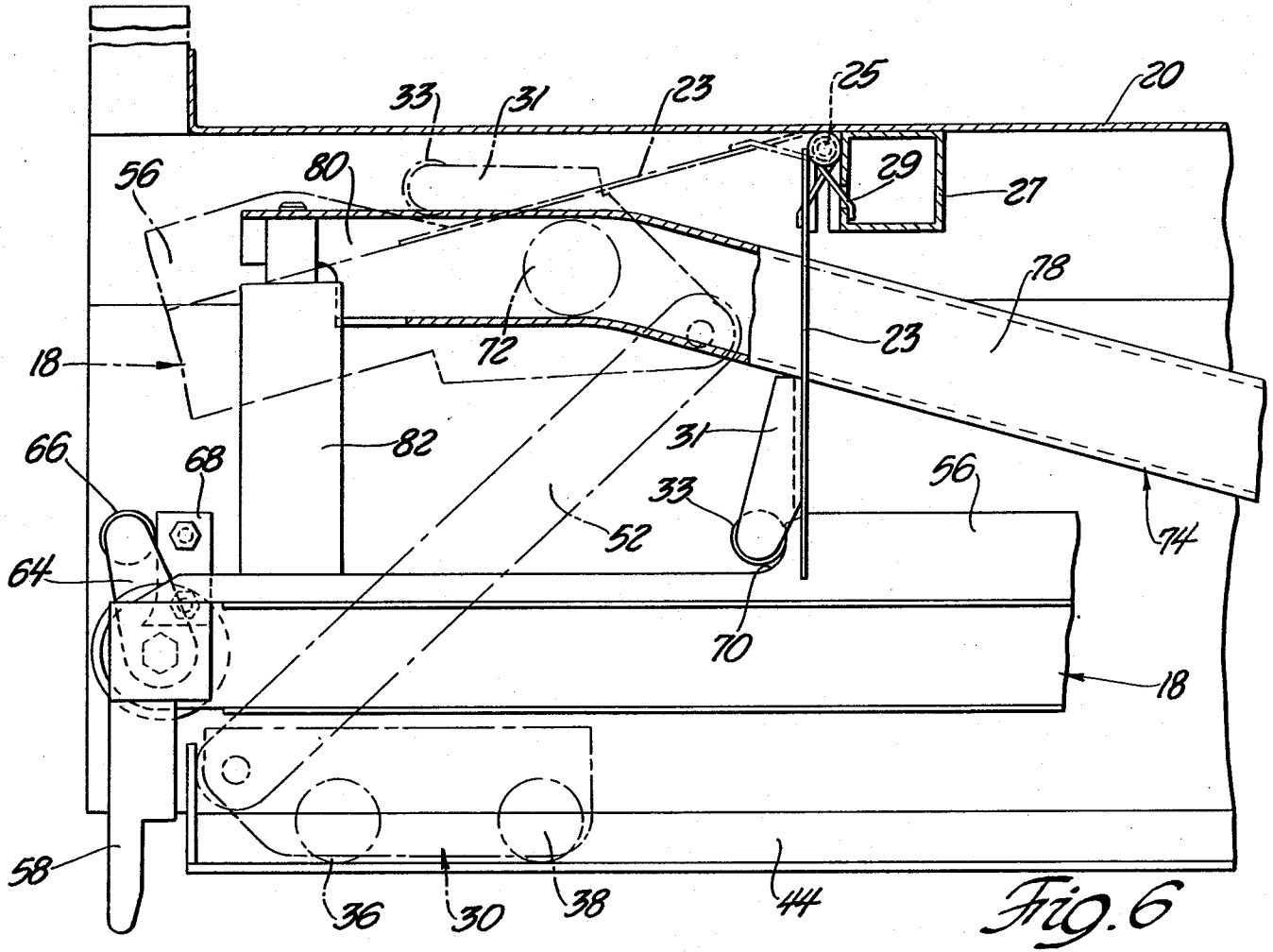
FIG. 6 is an enlarged view of the left side of FIG. 3 showing the outer end of the retracted ramp.

As seen in FIG. 6, riser 23 is pivotally mounted to the vehicle floor structure through a shaft 25 supported in floor beam 27. A suitable spring member 29 is connected between floor beam 27 and riser 23 and biases the latter in a counterclockwise direction. A bracket 31 is secured to one lateral side of the riser and includes a follower 33 rotatably mounted thereon. As will be discussed subsequently, follower 33 engages ramp 18 to maintain the riser in its vertical position and with outer end 22 of the ramp forming a step into the bus as seen in FIGS. 3 and 6.

The bus includes a suitable subframe structure indicated generally at 24 which supports the bus floor 20 and also supports and houses the ramp and its operating mechanism.

Figure 4:
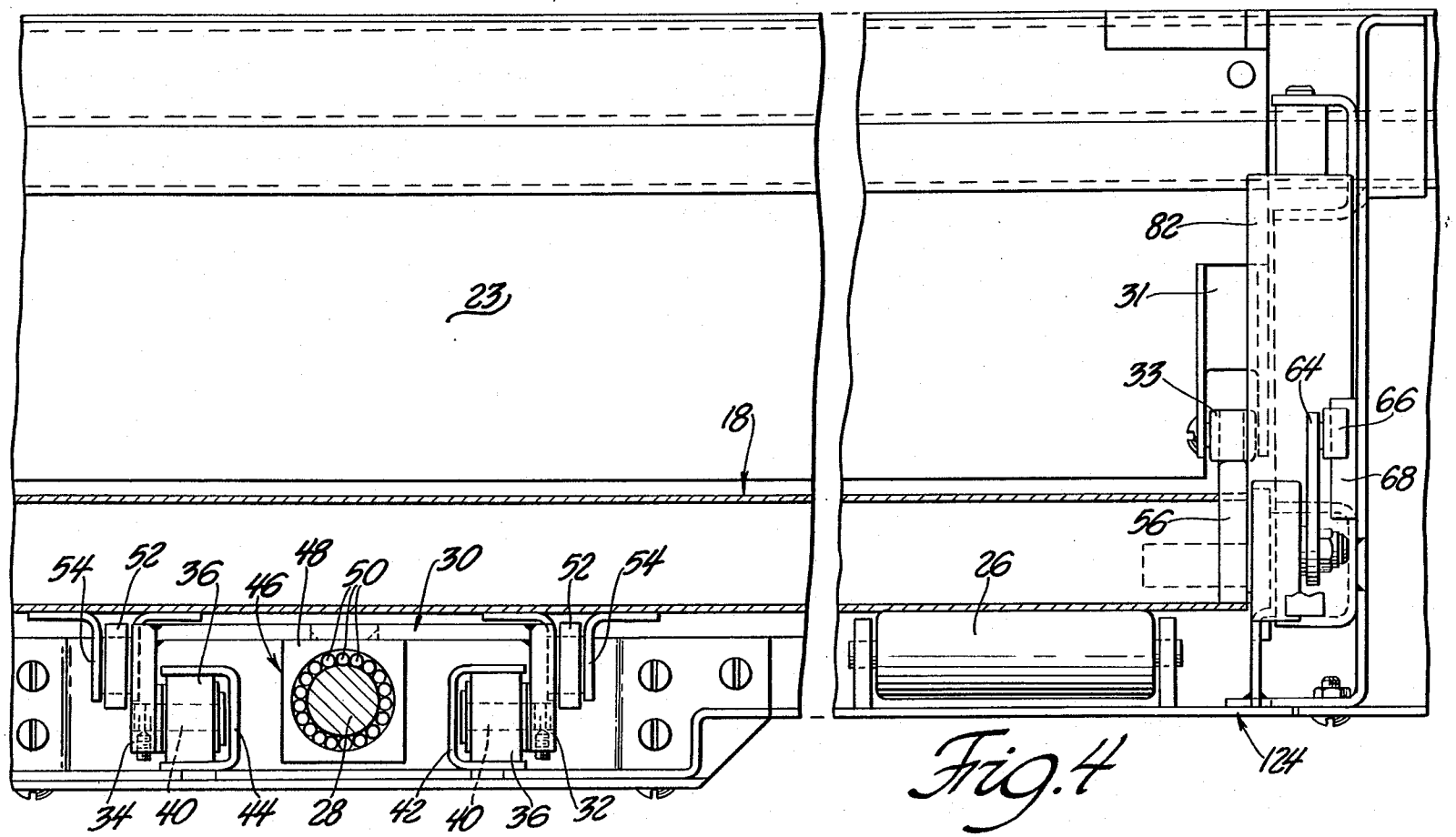
FIG. 4 is a partial end view of FIG. 3 and including a partial sections through the traveller mechanism and the ramp.
Figure 7:
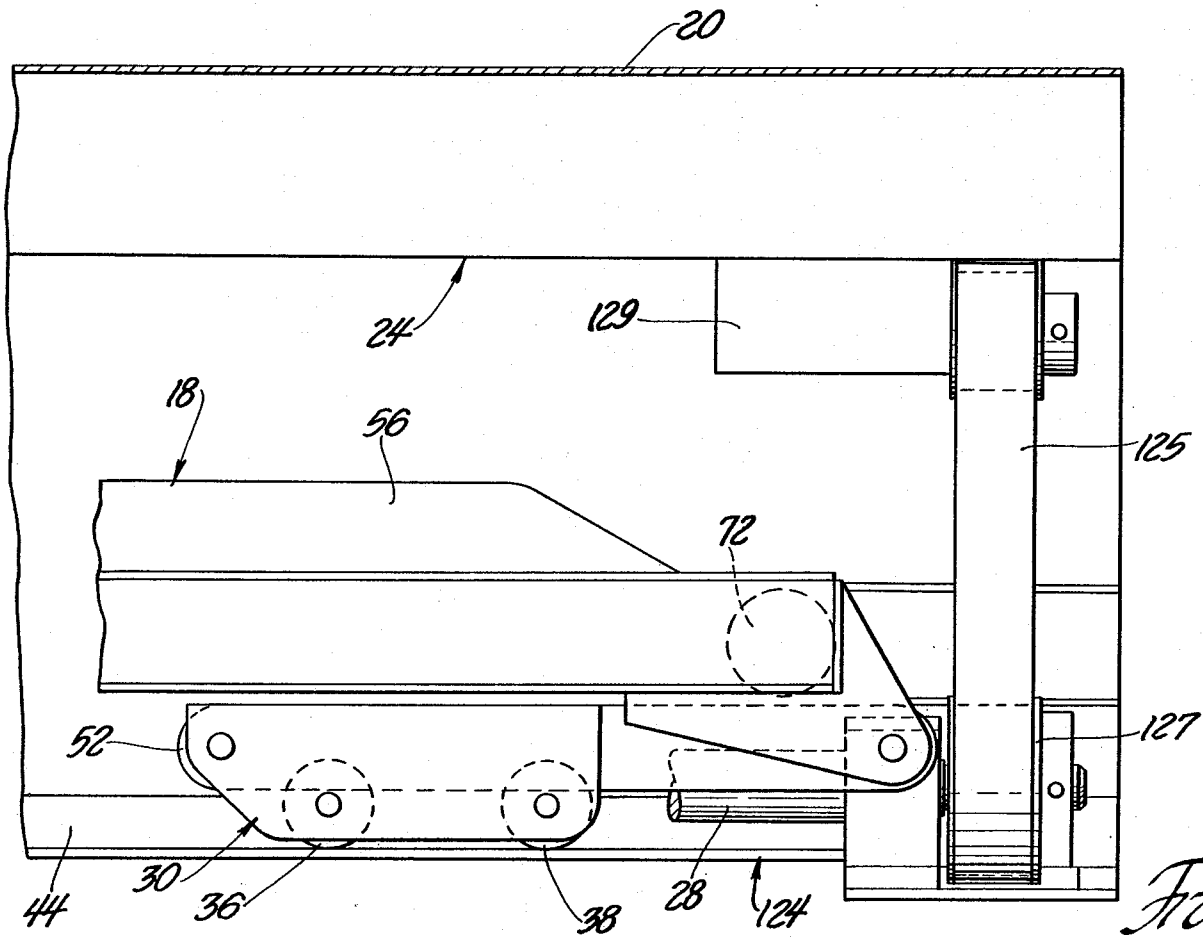
FIG. 7 is an enlarged view of the right side of FIG. 3 showing the inner end of the retracted ramp.

The ramp and its operating mechanism will now be described in detail with particular reference to FIGS. 2 through 7. Referring particularly to FIG. 4, when the ramp is in its fully and partially stored positions beneath the vehicle floor, it is supported adjacent its laterally outer edges upon a plurality of sets of roller devices 26 which are, in turn, suitably mounted upon part of the vehicle subframe structure 24. A ramp driving screw is indicated at 28 and is supported for rotation within a housing, not shown, and which housing is, in turn, suitably supported to the bus subframe 24. As seen in FIGS. 2, 3 and 7, the inner end of rotatable screw has a pulley 127 fixed thereto and is adapted to be driven by a motor 129 through a suitable flexible belt 125.

As best seen in FIG. 4, an inverted U-shaped bracket or traveller 30 is mounted for movement transversely of vehicle 10. Bracket 30 includes downwardly extended side legs 32 and 34 which support two sets of inwardly disposed rollers 36 and 38 upon spindles 40. Tracks 42 and 44 are supported upon vehicle subframe 24 and which tracks are parallel to and outwardly spaced from drive screw 28. Bracket rollers 36 and 38 are rollingly supported within tracks 42 and 44.

A conventional roller ball-drive device is depicted at 46 and includes a casing 48 fixed to the underside of bracket 30 and which casing movingly contains a plurality of ball members 50. The ball members 50 are adapted to track within a limited length of external thread of screw member 28. Thus, when motor 29 is energized to rotate drive screw 28, contained ball members 50 impart axial movement to bracket 30 along the length of the drive screw.

Bracket 30 is drivingly connected to ramp 18 through a pair of levers 52 respectively pivotally connected at one end to bracket 30 and at the other end to the underside of the ramp through brackets 54.

Figure 5:
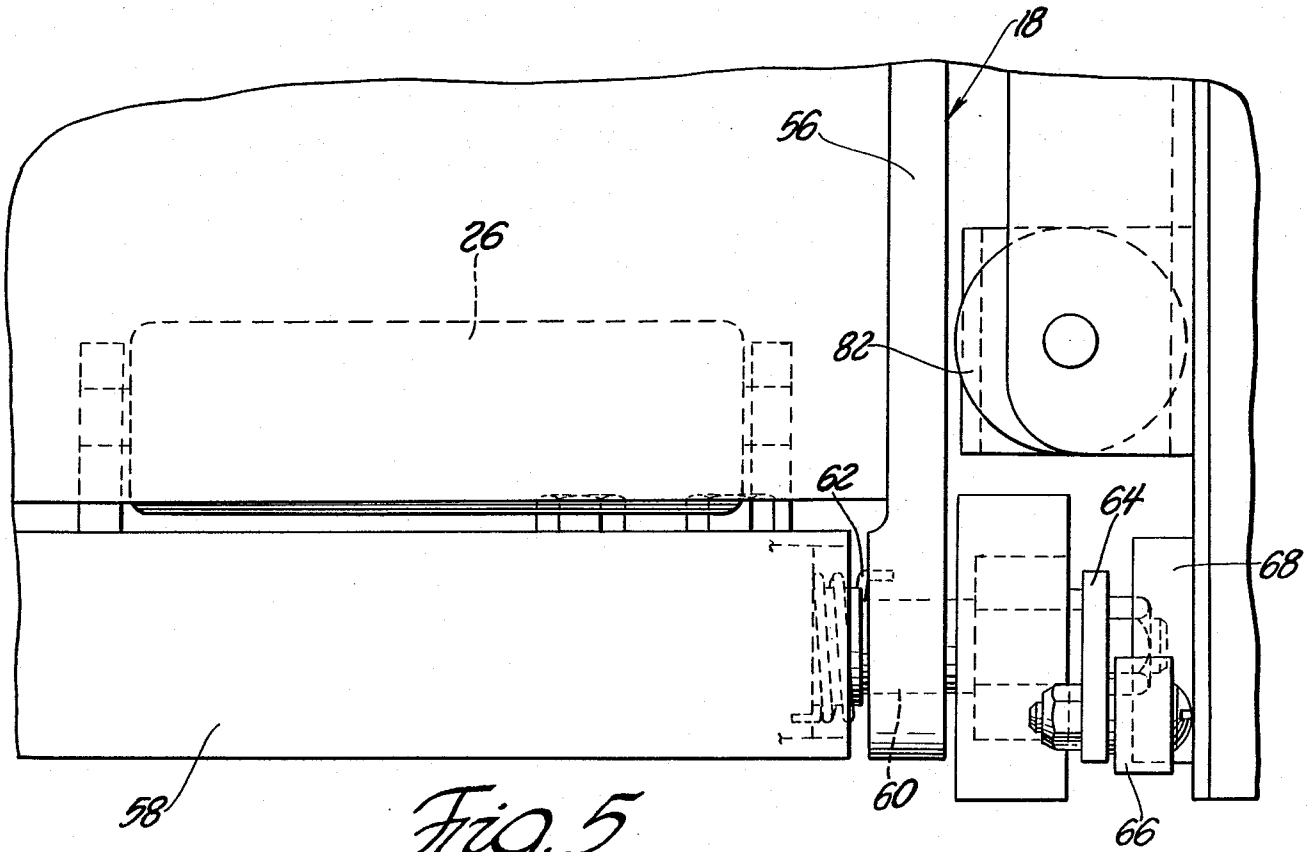
FIG. 5 is a partial plan view of the ramp, sensitive edge and edge cam mechanism with the ramp retracted as in FIG. 3.
Figure 8:
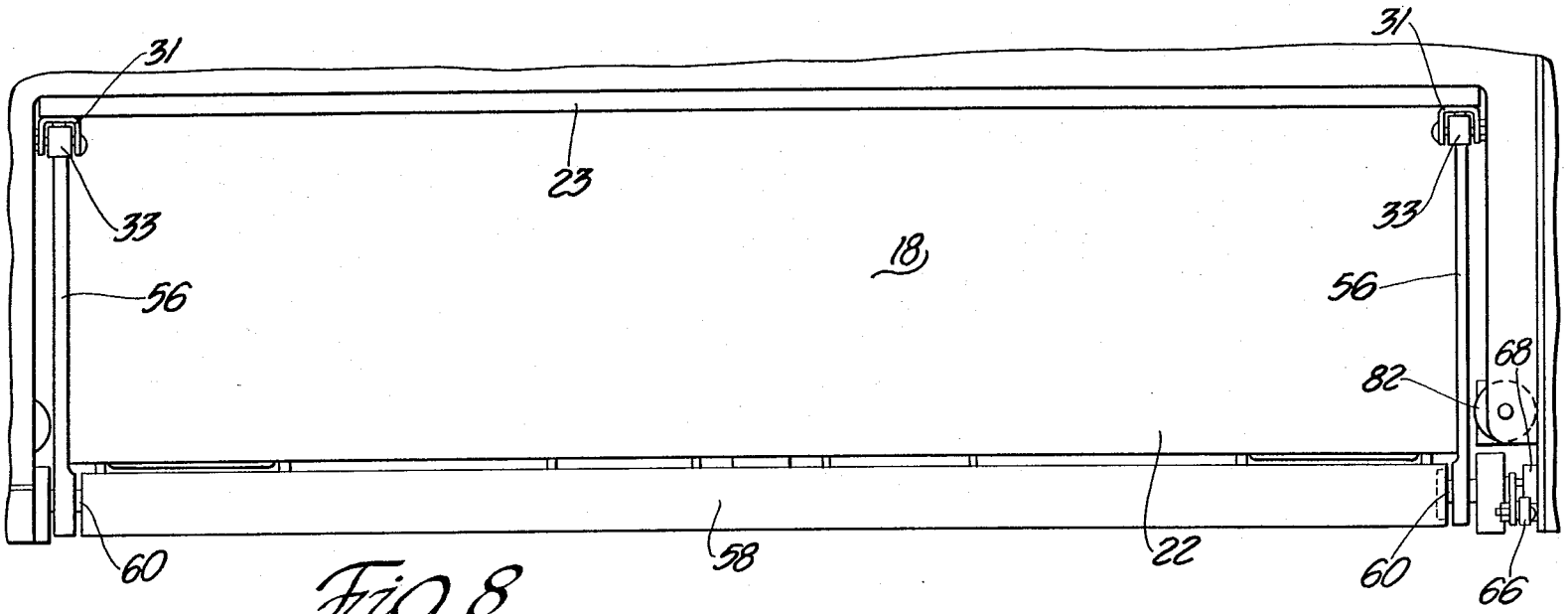
FIG. 8 is a partial plan view of the left side of FIG. 3 showing the step when the ramp is retracted.
Figure 9:
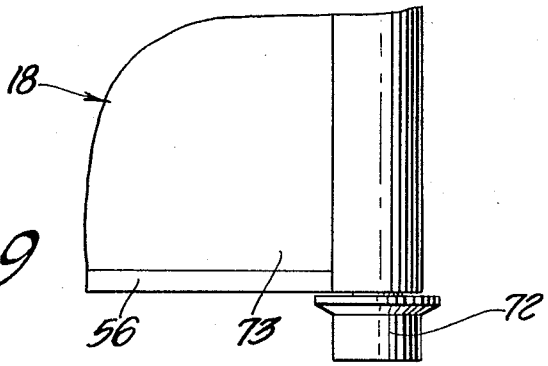
FIG. 9 is a partial plan view of the inner right hand corner of the ramp to show the ramp-raising roller.

Referring to FIGS. 4 through 6, ramp 18 includes side rails 56 respectively secured to each side of the ramp. The rails extending throughout the length of the ramp and, as particularly seen in FIGS. 1 and 4, extend above the ramp to restrain a wheelchair or handicapped individual from inadvertently slipping off the ramp. As seen in FIGS. 5 and 8, rails 56 project longitudinally beyond the outer end 22 of the ramp to rotatably support a sensitive edge member 58 adapted to provide a smooth transition from the ramp to the ground when the ramp is extended as shown in FIG. 2. The two operative positions of edge 58 are shown in FIGS. 2 and 3. As shown in FIGS. 5 and 8, edge 58 is rotatably supported upon the extended portions of side rails 56 through shaft members 60. A suitable spring member 62 surrounds shaft 60 and is anchored at its respective ends to edge 58 and side rail 56. Spring 62 is connected so as to bias the edge 58 to its extended position as shown in FIG. 2.

When ramp 18 is fully retracted, it is desired that edge 58 be rotated to its downward position as shown in FIGS. 3 and 5. To achieve the downward position against the force of spring 62, the right hand edge of supporting shaft 60 as viewed in FIGS. 4, 5, 6 and 8 extends laterally and includes an arm 64 fixed thereto. A follower 66 is rotatably mounted on the free end of arm 64. A cam member 68 is mounted proximate the side of the vehicle door opening. As ramp 18 approaches its fully retracted position, edge follower 66 engages cam 68 and, during the final amount of ramp retracting movement, rotates edge 58 to its retracted or downward position As earlier noted, riser follower 33 abuts against ramp 18 under the force of riser spring 29. More specifically and as best seen in FIG. 6, follower 33 rides atop one of the side rails 56. In order to allow the riser 23 to move to a vertical position, rail 56 is notched or recessed inwardly from its outer end to provide a shoulder 70. When the ramp is fully retracted, side rail notch 70 is engaged by riser follower 33 to resiliently maintain the riser in its vertical or step position.

In its fully extended position, as in FIG. 1 or in dashed lines in FIG. 6, the inner end of ramp 18 must be raised to reach the level of vehicle floor 20. A pair of roller members 72 are mounted outboard at the inner end 73 of ramp 18. Mounted upon the vehicle subframe structure 24 are a pair of tracks indicated generally at 74, only one of which is shown, disposed proximate to and extending coextensively length-wise of the ramp. Ramp rollers 72 are disposed within or ride upon tracks 74. As best viewed in FIGS. 2 and 3, tracks 74 include a horizontal section 76 extending from the inner end of the retracted ramp in the direction of the vehicle door, an upwardly inclined section 78 terminating slightly outboard of riser 23 and a short second horizontal section 80 terminating laterally near the outer end of the retracted ramp.

As best seen in FIGS. 4 and 5, a pair of vertical rollers 82 are suitably mounted on the vehicle subframe proximate the door step. Rollers 82 are adapted to guide ramp 18 as it is being extended and retracted and to thereby maintain its longitudinal axis normally to the vehicle centerline.

Operation Of The Ramp

Start with the ramp in the retracted position of FIG. 3. To extend the ramp, the operator energizes motor 129 to rotate drive screw 28. This action causes traveller bracket 30 to move axially along the screw toward the vehicle door and imparts such movement through levers 52 to ramp 18. As the ramp reaches about two-thirds of its outward travel, ramp rollers 72 ride up inclined track section 78 to progressively raise inner end of the ramp. When the ramp rollers reach the horizontal track section 80 the ramp inner end is at floor level and riser followers 33 has ridden along ramp side rails 56 to lift the riser 23 to the flush position shown in FIGS. 2 and 6 to smoothly bridge any gap between the ramp and the vehicle floor.

As soon as ramp 18 begins its extending movement, ramp edge follower 66 moves away from body mounted cam 68 allowing spring 62 to move the edge to the extended position shown in FIG. 2 and in which position it will contact the ground when the ramp is fully extended.

It is apparent that modifications may be made within the intended scope of the invention as set forth in the hereinafter appended claims.

What is claimed is:

1. A vehicular passenger boarding system of the type including a door opening (12), a floor (20) within the vehicle, a ramp member (18) storable beneath said floor and including inner and outer ends (73 and 22), a screw member (28) rotatably mounted in the vehicle subframe structure (24) beneath the vehicle floor and adjacent said ramp, said screw member having a first end disposed proximate the inner end (73) of said ramp when the ramp is stored beneath the vehicle floor and an outer end terminating proximate the door opening; motor means (29) secured to said vehicle beneath said floor and drivingly connected to said screw member; traveller means (30) including elements (50) coacting with the screw member (28) and adapted to move the traveller means axially relative to the screw member when the latter is rotated; linkage means (52) pivotally connecting the traveller means (30) and the inner end of the ramp whereby said ramp is moved laterally of the vehicle to extend through the door opening when the motor means is actuated; and means (74) for lifting the inner end of said ramp to the vehicle floor level when the ramp is in its fully laterally extended position whereby a passenger may enter or leave the vehicle by traversing said ramp without the impediment of a step, the improvement comprising:

A. the lifting means including track members (74) supported beneath said vehicle floor and including generally horizontal sections (76) respectively disposed proximate the lateral sides of the ramp when said ramp is in its retracted position within the vehicle; said track members including (1) upwardly inclined portions (78) terminating subadjacent the floor (20) and proximate door opening (12);

B. roller elements (72) mounted upon said ramp proximate the inner end and respectively at the lateral sides thereof; said roller elements respectively adapted to roll upon the track members (74) as said ramp member moves laterally of the vehicle and to raise the inner end of said ramp to the approximate level of said floor when the ramp reaches its fully extended position outboard of the vehicle.

2. A vehicular passenger boarding system of the type including a door opening (12), a floor (20) within the vehicle, a ramp member (18) storable beneath said floor and including inner and outer ends (73 and 22), a screw member (28) rotatably mounted in the vehicle subframe structure (24) beneath the vehicle floor and adjacent said ramp, said screw member having a first end disposed proximate the inner end (73) of said ramp when the ramp is stored beneath the vehicle floor and an outer end terminating proximate the door opening; the outer end (22) of the ramp forming the horizontal part of a step in the vehicle door opening when the ramp is in its stored position; a riser (23) pivotally mounted to the floor (20) proximate the door opening (12) and forming the vertical part of the step when the ramp is in its stored position; motor means (29) secured to said vehicle beneath the floor and drivingly connected to said screw member; traveller means (30) including elements (50) coacting with the screw member (28) and adapted to move the traveller means axially relative to the screw member when the latter is rotated; linkage means (52) pivotally connecting the traveller means (30) and the inner end of the ramp whereby said ramp is moved laterally of the vehicle to extend through the door opening when the motor means is actuated; and means (74) for lifting the inner end of said ramp to the vehicle floor level when the ramp is in its fully laterally extended position whereby a passenger may enter or leave the vehicle by traversing said ramp without the impediment of a step, the improvement comprising:

A. the lifting means including track member (74) supported beneath said vehicle floor and including generally horizontal sections (76) respectively disposed proximate the lateral sides of the ramp when said ramp is in its retracted postion within the vehicle; said track members including (1) upwardly inclined portions (78) terminating subadjacent the floor (20) and proximate door opening (12);

B. roller elements (72) mounted upon said ramp proximate the inner end and respectively at the lateral sides thereof; said roller elements respectively adapted to roll upon the track members (74) as said ramp member moves laterally of the vehicle and to raise the inner end of said ramp to the approximate level of said floor when the ramp reaches its fully extended position outboard of the vehicle.

3. A vehicular passenger boarding system of the type including a door opening (12), a floor (20) within the vehicle, a ramp member (18) storable beneath said floor and including inner and outer ends (73 and 22), a screw member (28) rotatably mounted in the vehicle subframe structure (24) beneath the vehicle floor and adjacent said ramp, said screw member having a first end disposed proximate the inner end (73) of said ramp when the ramp is stored beneath the vehicle floor and an outer end terminating proximate the door opening; the outer end (22) of the ramp forming the horizontal part of a step in the vehicle door opening when the ramp is in its stored position; a riser (23) pivotally mounted to the floor (20) proximate the door opening (12) and forming the vertical part of the step; an edge member (58) pivotally mounted to the outer end of and transversely coextensive with said ramp; motor means (29) secured to said vehicle and drivingly connected to said screw member; traveller means (30) including elements (50) coacting with the screw member (28) and adapted to move the traveller means axially relative to the screw member when the latter is rotated; linkage means (52) pivotally connecting the traveller means (30) and the inner end of the ramp whereby said ramp is moved laterally of the vehicle to extend through the door opening when the motor means is actuated; and means (74) for lifting the inner end of said ramp to the vehicle floor level when the ramp is in its fully laterally extended postion whereby a passenger may enter or leave the vehicle by traversing said ramp without the impediment of a step, the improvement comprising:

A. the lifting means including track members (74) supported beneath said vehicle floor and including generally horizontal sections (76) respectively disposed proximate the lateral sides of the ramp when said ramp is in its retracted position within the vehicle; said track members including (1) upwardly inclined portions (78) terminating subadjacent the floor (20) and proximate door opening (12);

B. roller elements (72) mounted upon said ramp proximate the inner end and respectively at the lateral sides thereof; said roller elements respectively adapted to roll upon the track members (74) as said ramp member moves laterally of the vehicle and to raise the inner end of said ramp to the approximate level of said floor when the ramp reaches its fully extended position outboard of the vehicle.

4. A vehicular passenger boarding system as set forth in claim 3 wherein a spring element (29) is disposed between the vehicle floor (20) and the riser (23) to bias the riser toward the ramp, a portion (70) of said ramp adapted to be engaged by and to position the riser in a substantially vertical position when the ramp is in its fully retracted position.

5. A vehicular passenger boarding system as set forth in claim 4 wherein the ramp engages and rotates the riser against the force of the spring element (29) whereby the riser provides a bridge between the floor (30) and the ramp (18) when the ramp is in its fully outwardly extended position.

6. A vehicular passenger boarding system as set forth in claim 5 wherein said riser includes follower means (33) mounted thereon and biased by said spring into engagement with said ramp.

7. A vehicular passenger boarding system as set forth in claim 5 which includes a second spring element (62) disposed between the ramp (18) and the edge member (58) to bias the edge member to a position generally planar with the upper surface of the ramp; a lever (64) fixed to the edge member; a cam member (68) mounted upon the vehicle proximate the door opening; said edge lever engaging the cam member when the ramp approaches its fully retracted position to rotate the edge to a generally downwardly normal position relative to the ramp.

8. A vehicular passenger boarding system as set forth in claim 7 wherein the ramp (18) includes a pair of side rail elements (56) respectively secured to the lateral sides thereof and projecting above the upper surface of the ramp.

9. A vehicular passenger boarding system as set forth in claim 8 wherein the side rail elements (56) project longitudinally beyond the outer end (22) of the ramp to rotatably support the edge member (58).

10. A vehicular passenger boarding system as set forth in claim 7 in which the riser (23) includes follower means (33) biased into engagement with the upper edge of at least one ramp side rail (56).

* * * * *